United States Patent [19]

Proctor et al.

[11] Patent Number: 4,779,511

[45] Date of Patent: Oct. 25, 1988

[54] DISPOSAL DEARMER FOR EOD APPLICATIONS

[75] Inventors: Paul W. Proctor, White Plains; Robert L. Dow, La Plata, both of Md.

[73] Assignee: The United States of America as represented by the Secretary of the Navy, Washington, D.C.

[21] Appl. No.: 753,519

[22] Filed: Jul. 9, 1985

[51] Int. Cl.[4] ..... F42B 33/06

[52] U.S. Cl. ..... 86/50

[58] Field of Search ..... 86/1.1, 49, 50; 89/15, 89/16, 19, 14, 1.35, 1.3; 30/DIG. 4

[56] References Cited

U.S. PATENT DOCUMENTS

| | | | |
|---|---|---|---|
| 2,926,565 | 3/1960 | Thorness | 89/1.14 |
| 3,109,369 | 11/1963 | Plumbley | 86/50 |
| 3,117,518 | 1/1964 | Porter et al. | 86/50 |
| 3,782,239 | 1/1974 | Wick et al. | 86/49 |
| 3,991,649 | 11/1976 | Patrichi | 89/1.14 |
| 4,062,112 | 12/1977 | Lake | 86/50 |
| 4,169,403 | 10/1979 | Hanson | 89/1.14 |

*Primary Examiner*—Frederick R. Schmidt
*Assistant Examiner*—Robert A. Rose
*Attorney, Agent, or Firm*—K. E. Walden; T. M. Gernstein

[57] ABSTRACT

A disposable EOD dearmer (10) includes an propellant charge (36) permanently affixed to a tubular body (14) for propelling a dearmer slug (40) against a dud casing (12). The pressure versus time characteristic (60, 70) of the charge can be selected to provide a preselected velocity for the slug at impact with the casing, and the initial position (60', 70'') of the slug can be selected to provide a preselected delay between ignition of the charge and impact between the slug and the casing.

1 Claim, 1 Drawing Sheet

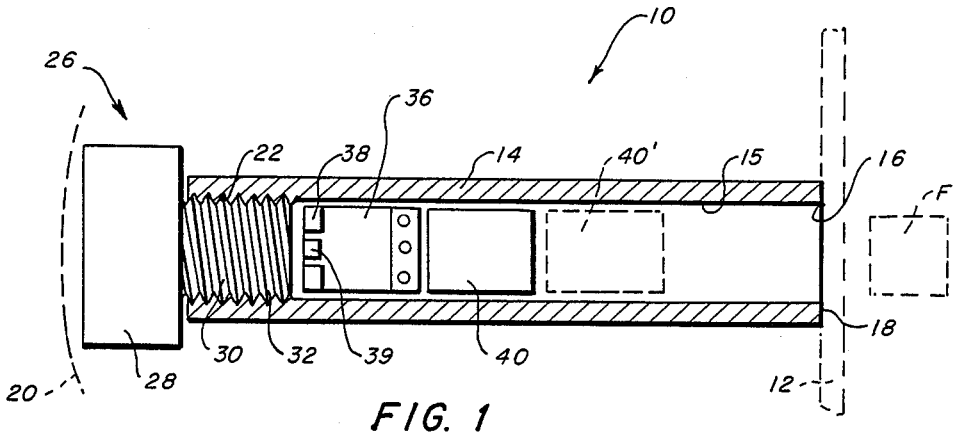
FIG. 1
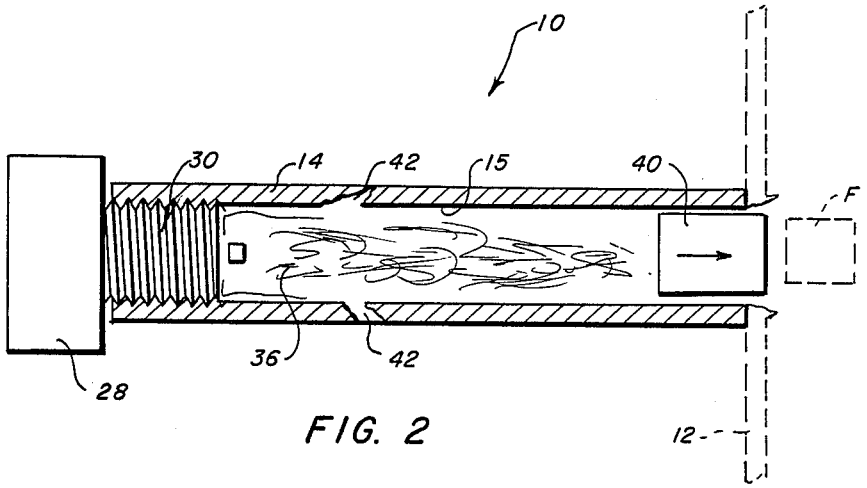
FIG. 2
FIG. 3
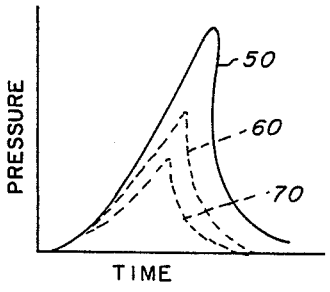
FIG. 4
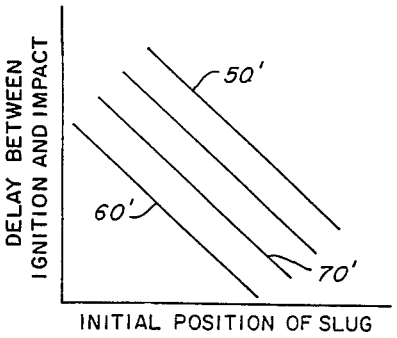

DISPOSAL DEARMER FOR EOD APPLICATIONS

BACKGROUND OF THE INVENTION

1. Technical Field

The present invention relates generally to explosive ordnance disposal, and more particularly to dearming explosive ordnance devices by disabling or damaging the fuze element of such devices. Most specifically, the present invention relates to improving the design and operation of such dearming devices.

2. Background Art

One technique for rendering an explosive ordnance device safe is to dearm that device by rendering its fuze mechanis inoperative. This can be accomplished by destroying or damaging that fuze mechanism so the firing pin thereof will not be able to contact the detonator device. In this manner, the detonator will not be able to set off the warhead of the ordnance device. Dearming an explosive ordnance in this manner requires propulsion of a fuze destroying device against the fuze with enough power to sufficiently damage the fuze to render it inoperative. This result is generally accomplished by firing a slug from a tube aimed at the fuze with enough velocity to impact a portion of the fuze extending out over the ordnance case. This impact bends the whole fuze body making firing pin movement impossible, or in some cases, actually decapitating a portion of the ordnance item. The dearming device therefore includes tube with an propellant charge and a plug housed therein. The propellant charge is set off by a primer and propels the slug out of the tube at a velocity characteristic of that propellant charge.

Currently available dearmers are designed to be reusable. Accordingly, these dearmers use available propellant charges and are assembled by the operator at the use site. This design has several drawbacks. First, assembly at the use site requires the operator to work in the vicinity of an unexploded ordnance device, which in and of itself is undesirable. Second, using propellant charges requires using a charge that is adequate for the largest ordnance device in order to be of universal application. This, in turn, causes the propellant charge to be too large for most applications. Not only is this uneconomical, it causes problems in aiming the dearmer, as a large charge may produce a kick-back after firing of the dearmer thereby affecting the aiming of that dearmer. It is desirable to avoid the kick-back problem if possible. Accordingly, currently available dearmers are difficult to set-up and aim. Heavy weighting equipment may be necessary to absorb the kick-back and this makes of even more difficult to set up and aim the dearmer. As the charges are usually quite large, the dearmer must be heavy to accommodate the charge. This makes the dearmer bulky and difficult to transport. Presently, only one, and no more than two, dearmers can be carried by one EOD technician. After setting up one or two units, the EOD technician must return for additional slugs and cartridges thereby creating logistics a problem.

A further problem with using currently available propellant dearmer is that they are generally not protected against stray electromagnetic or electrostatic energy. These charges are therefore susceptible to inadvertent detonation.

Yet another problem with currently available dearmers is the cost of manufacturing them. Every time a dearmer is used, there may be damage to the tube due to the set back impact collisions. Heretofore, it has been assumed that the internal bore of these tubes must be extremely smooth in order to properly aim the slug. Thus, the reusable dearmer must be carefully maintained thereby making them expensive to manufacture and maintain.

OBJECTS OF THE INVENTION

It is a main object of the present invention to provide an EOD dearmer which is easily manufactured, transported and aimed.

It is another object of the present invention to provide a disposable EOD dearmer.

It is another object of the present invention to provide a disposable EOD dearmer which can be matched to a particular application.

It is another object of the present invention to provide a disposable EOD dearmer which can be set off in sequence with other disposable EOD dearmers.

It is another object of the present invention to provide an EOD dearmer which requires only minimal machining to produce.

It is another object of the present invention to provide an EOD dearmer which is safer than currently available EOD dearmers.

It is another object to provide a safe EOD dearmer which is less susceptible to stray electrostatic and electromagnetic energy than present dearmers.

It is another object of the present invention to provide an EOD dearmer which can be quickly set up to reduce the time an EOD technician must spend in the vicinity of a dud ordnance.

It is another object of the present invention to provide an EOD dearmer which has the capability for multiple option firing.

It is another object of the present invention to provide an EOD dearmer which does not need to be restrained in the firing position.

It is another object of the present invention to provide a disposable EOD dearmer which is self-contained whereby an EOD technician need not assemble a plurality of disparate components to set up the device.

SUMMARY OF THE INVENTION

These and other objects are accomplished by a disposable EOD dearmer which includes an propellant charge mounted in a tube adjacent to a slug. The propellant charge is designed to produce a specially selected pressure versus time characteristic in order to propel the slug with a velocity which is predetermiend to be necessary for dearming a particular ordnance device with which the dearmer will be used. In this manner, the dearmer need not be larger and more powerful than necessary. Being disposable, the dearmer can be completely self-contained and can be manufactured as economically as possible. This advantage alleviates the aforementioned logistics and set-up problems for the EOD technician and also reduces the overall cost of these units.

BRIEF DESCRIPTION OF THE DRAWINGS

A more complete understanding of the invention and a fuller appreciation of the many attendant advantages, features and still other objects thereof will be readily derived by reference to the following detailed description when considered in connection with the accompanying drawings, wherein:

FIG. 1 is a cutaway elevation view of the EOD dearmer of the present invention in a ready condition;

FIG. 2 is a cutaway elevation view of the FIG. 1 EOD dearmer in the post-firing condition;

FIG. 3 shows pressure versus time curves for the EOD dearmer of the present invention as compared to the currently available EOD dearmers; and FIG. 4 shows delay between ignition and impact versus initial position of the slug for various explosive characteristics.

DETAILED DESCRIPTION OF THE PREFERRED EMBODIMENT

Shown in FIG. 1 is a disposable EOD dearmer 10 aimed at an ordnance device, such as a bomb or the like. The EOD dearmer includes a tubular body 14 having a bore 15 with an open end 16 aimed at the protruding portion of the fuze of a dud ordnance item. The body 14 can be spaced from a casing 12, or held thereon by suitable fastening means, such as adhesive 18 straps 20, illustarted in phantom, or the like. The dearmer is aimed at the protruding portion of the fuze mechanism F of the ordnance device whereby activation of the dearmer will damage or destroy that fuze mechanism to prevent it from detonating the ordnance device.

The tubular body 14 has a thread 22 internally of bore 15 at the end thereof remote from the open end 16. A closure means 26 includes a body 28 and a boss 30 which has a threads 32 thereon for engagement with the tubular body thread 22 to attach the closure means to that tubular body. A propellant charge 36 is received in the bore 15 and includes a primer mechanism 38 and a means 39 for preventing the inadvertent firing of the charge by stray electromagnetic or electrostatic energy. Such means can include coils or the like such as disclosed in U.S. Pat. Nos. 2,821,139, 2,918,001, 3,762,331 or 4,304,184. The primer mechanism 38 can be a ring staked percussion primer, if suitable, and can be used to seal the tube bore for preventing gas leakage once the primer has been fired.

The closure means 26 can include firing means for firing the propellant charge. Such firing means can include a disposable timer or an electronic means, as suitable. The firing means can be coupled with other EOD dearmer firing means or the timer can be set in conjunction with the firing means of other EOD dearmers to set off a plurality of EOD dearmer in sequence. If the timer means is used for a plurality of dearmers, each successive timer is set to have slightly less time delay whereby the last timer set has the shortest delay and the first timer set has the longest delay so all of the plurality of EOD dearmers are set off sequentially, or simultaneously as suitable.

A standard dearmer slug 40 is mounted in the tubular body 14 adjacent to the propellant charge 36 to be propelled out of the body when that propellant charge is ignited.

FIG. 2 shows the dearmer 10 in a post firing configuration with the propellant charge 36 expended and slug 40 on its way toward firing fuze mechanism F. The detonation of charge 36 may damage the bore 15 as indicated at 42 in FIG. 2. This damage may not occur, and may be far less extensive than that shown in FIG. 2; however, the damage is shown to indicate that if the device 10 is to be reused, it may have to be repaired prior to such reuse. The damage to the dearmer is caused by the reaction force from firing of the big propellant charge which may propel the dearmer great distances. The unit may impact rocks, structures, etc., thereby deforming the tube so that either the propellant charge or the slug will not fit into the barrel. The prior art dearmers are designed with thick walls in order to overcome this problem. The thick walls make these prior art units very heavy but repairs are still necessary from time to time.

It is noted that the present inventors discovered that an air bearing is formed between the slug 40 and the bore 15. Therefore, slight damage to or irregularities in, the bore 15 do not significantly affect the movement of the slug out of the bore. Heretofore, it was thought that the bore had to be highly polished in order to provide a smooth surface for guiding the slug. Since this is not the case, bore 15 of the EOD dearmer 10 need not be highly finished and can be made without machining, thereby producing savings in cost and difficulties associated with manufacture.

Because the device 10 is disposable, it can be manufactured to be specific to a particular application. This customizing is effected by adjusting the propellant charge 36 to produce a desired pressure versus time curve. This customizing is shown schematically in FIG. 3. The curves in FIG. 3 are intended only to show the customizing feature and trends of the present invention and are not intended to show absolute values of the variable. Thus, curve 50 corresponds to a charge suitable for propelling the slug at the same velocity as the charge associated with currently available dearmers. This large charge causes the aforementioned aiming and set-up problems due to kick-back, logistics problems due to its size, and cost problems as it is too large for most purposes. The charge used in the current dearmer is a .50 caliber explosive. It is noted that different slug velocities are obtained by setting the slug at different locations in the barrel. The deeper in the barrel the higher the velocity. The dearmer itself does not require different propellant charges in order to destroy different targets. The propellant charges in the disposable dearmer are tailored in order to get rid of spikes and peaks associated with the .50 caliber propellant charge.

For purposes of comparison, FIG. 3 also shows a curve 60 which corresponds to the device 10 shown in FIGS. 1 and 2 and another curve 70 corresponding to yet another charge suitable for use in the presently disclosed dearmer. Other curves can also be developed with curves 60 and 70 being representative only. The pressure peaks of the curves 60 and 70 are lower than the curve 50 so the dearmer 10 need not be as large and heavy as the current dearmers. Thus lightweight steel can be used for the dearmer 10. The time when the pressure peak occurs can also be adjusted as suitable to make an individual dearmer as efficient as possible. The build-up and decay portions of the curves 60 and 70 can also be adjusted as suitable. A suitable explosive for the charge 36 includes a mixture of fast and slow burning propellant grains, with the proportions and type of the grains being selected to produce the desired characteristic pressure versus time curve.

The position of the slug 40 in the bore 15 can be varied to adjust the delay time between ignition of the explosive and impact of the slug with the casing 12. This feature of the dearmer is indicated in FIG. 1 by the phantom showing for a dearmer slug 40'. The initial position of the slug can be chosen to account for the characteristics for the pressure versus time curve of the explosive charge being used. In this manner, the impact of the slug with the casing 12 and fuze F can be precisely controlled to be the most effective and the most efficient possible. This feature is indicted in FIG. 4 wherein curve 60' corresponds to the delay time versus initial slug position for an explosive mixture having the pressure versus time characteristic identifies in FIG. 3 by the reference numeral 60, while curve 70' corresponds to the FIG. 3 curve, and curve 50' corresponds to the FIG. 3 curve 50. As before, the FIG. 4 curves represent only trends and general characteristics and not actual values or precise relationships. These curves, like those in FIG. 3, are illustrative only and are not analtyical tools.

It is noted that the dearmer body 14 can be formed of any material as long as it will provide the correct clearance with the dearmer slug 40 during firing, can contain the explosive long enough to expell the slug with the proper velocity and can contain the primer 40 prevent premature vening of the propellent glases. Fiberglass (TM) reinforced materials can be used for the tubular body to reduce the weight if suitable.

The dearmer can be formed using non-magnetic materials to protect against magnetic sensitive sensors.

Obviously, numerous modifications and variations of the present invention are possible in the light of the above teachings. It is therefore to be understood that within the scope of the appended claims the invention may be practiced other wise than as specifically described herein.

What is claimed as new and desired to be secured by Letters Patent of the United States is:

1. A method of dearming explosive ordnance by disabling a fuze inside a casing thereof comprising the steps of:

selecting a open ended elongatged tubular body of lightweight, non-magnetic material;

selecting an appropriate charge for the tubular body fore for use against particular ordnance;

positioning a dearmer slug in the tubular body bore in front of the explosive charge and at a distance therefrom selected to provide upon detonation of the charge an appropriate pressure build up versus time to provide delay time between detonation of the charge and impact of the slug on the casing;

attaching the body to a casing with the open end in the vicinity of the fuze to be disabled; and firing the charge to expell the slug out the open end at a velocity and delay just sufficient to disable the fuze inside the casing of that particular ordnance.

* * * * *